US010442603B2

(12) United States Patent
Wagner et al.

(10) Patent No.: US 10,442,603 B2
(45) Date of Patent: Oct. 15, 2019

(54) PHARMACEUTICAL PACKAGE

(71) Applicant: Medcomb Holding APS, Copenhagen V (DK)

(72) Inventors: John Wagner, Værløse (DK); Flemming Wagner, Frederiksberg C (DK)

(73) Assignee: Medcomb Holding APS, Copenhagen V (DK)

( * ) Notice: Subject to any disclaimer, the term of this patent is extended or adjusted under 35 U.S.C. 154(b) by 0 days.

(21) Appl. No.: 16/084,872

(22) PCT Filed: Mar. 14, 2017

(86) PCT No.: PCT/DK2017/050072
§ 371 (c)(1),
(2) Date: Sep. 13, 2018

(87) PCT Pub. No.: WO2017/157397
PCT Pub. Date: Sep. 21, 2017

(65) Prior Publication Data

US 2019/0106266 A1 Apr. 11, 2019

(30) Foreign Application Priority Data

Mar. 16, 2016 (DK) ..... 2016 70154

(51) Int. Cl.
*B65D 83/04* (2006.01)
*A61J 1/03* (2006.01)
(Continued)

(52) U.S. Cl.
CPC ..... *B65D 83/0463* (2013.01); *A61J 1/035* (2013.01); *B65D 75/327* (2013.01);
(Continued)

(58) Field of Classification Search
USPC ..... 206/528, 531, 532, 534.1, 538
See application file for complete search history.

(56) References Cited

U.S. PATENT DOCUMENTS 3,246,746 A * 4/1966 Danforth ..... B65D 73/0092 206/462
9,642,773 B2 * 5/2017 Gelbaum ..... A61J 1/035
(Continued)

FOREIGN PATENT DOCUMENTS

WO WO 2013/041098 A1 3/2013

OTHER PUBLICATIONS

International Search Report for PCT/DK2017/050072 dated Jun. 9, 2017.

*Primary Examiner* — Jacob K Ackun
(74) *Attorney, Agent, or Firm* — Knobbe Martens Olson & Bear LLP

(57) ABSTRACT

The invention relates to a carrier for pharmaceutical compositions, the carrier comprising at least a first and a second portion. Each of the first and second portions comprises at least two cavities for housing pharmaceutical composition, and at least one cover sheet covering said at least two cavities. The cavities of the first and second portions are arranged so that the first and second portions can be placed in an overlapping configuration with the cavities of the first portion positioned in spaces between the cavities of the second portion. At least one of the cavities of the first portion comprises at least one bulge, and at least one of the cavities of the second portion comprises at least one depression adapted to engage with said at least one bulge to form a mutual engagement between the first and second portions. By this engagement, mutual movement of the first and second portions is restricted, so that a rigid structure is produced. The invention further relates to a pharmaceutical
(Continued)

package such a carrier and a container for holding said carrier.

14 Claims, 18 Drawing Sheets

(51) Int. Cl.
*B65D 75/32* (2006.01)
*B65D 75/52* (2006.01)

(52) U.S. Cl.
CPC .... *B65D 75/527* (2013.01); *B65D 2575/3245* (2013.01); *B65D 2585/56* (2013.01)

(56) References Cited

U.S. PATENT DOCUMENTS

| | | | | |
|---|---|---|---|---|
| 2011/0079530 | A1* | 4/2011 | Killinger | A61J 1/035 206/462 |
| 2016/0347524 | A1* | 12/2016 | Jones | A61J 1/035 |
| 2017/0333284 | A1* | 11/2017 | Jones | A61J 1/035 |

* cited by examiner

PHARMACEUTICAL PACKAGE

CROSS REFERENCE TO RELATED APPLICATIONS

This application is a U.S. National Phase Application of PCT International Application Number PCT/DK2017/050072, filed on Mar. 14, 2017, designating the United States of America and published in the English language, which is an International Application of and claims the benefit of priority to Danish Patent Application No. PA 2016 70154, filed on Mar. 16, 2016. The disclosures of the above-referenced applications are hereby expressly incorporated by reference in their entireties.

FIELD OF THE INVENTION

The present invention relates to a pharmaceutical package for pharmaceutical compositions or supplements such as dietary supplements.

BACKGROUND OF THE INVENTION

In medication, drug or dietary supplement compliance, a once-a-day regimen appears to be more effective than a multiple-doses-a-day regimen. Indeed patients more easily are able to follow a single daily medical advice rather than multiple daily medical advices.

Multiple packaging combining different pharmaceutical compositions or dietary supplements are thus useful to ensure adherence to an optimal daily regimen, defined daily dose (DDD), or recommended or Prescribed Daily Dose, i.e. a dose based on individual characteristics such as age and/or training habits.

However, combining different pharmaceutical compositions and/or supplements in a common package is not simple as it may lead to undesired reactions or interactions between the chemical compounds present in the different compositions and/or supplements.

In particular, under the development of dietary supplement, the reaction between the bioactive substances in the formulation may be a considerable issue leading to degradation of one or more bioactive substances. This could limit the combination of compositions in the final product, and/or the shelf life period of the product. It is thus challenging to decide on recipe and blending of substances in a final product and still keep good stability.

In general, to avoid direct contact between each formulation, each tablet/capsule has to be completely separately packaged in different containers, such as bottles. However, this is not convenient for the consumers.

Hence, an improved blister package would be advantageous, and in particular, a blister package facilitating convenient daily dose compliance would be advantageous.

OBJECT OF THE INVENTION

An object of the present invention is to provide a solution for holding several different pharmaceutical formulations or supplements in one single use package.

A further object of the invention is to provide a single use package that is adapted to hold different pharmaceutical compositions or supplements and that is easy to open.

Another object of the present invention is to provide a single use package that is easy to handle during use.

It is an object of at least some embodiments of the present invention to provide a pharmaceutical package which is easier to manufacture than prior art packages.

Another object of the present invention is to provide an alternative to the prior art.

It is an object of the present invention to wholly or partly overcome the above disadvantages and drawbacks of the prior art.

In particular, it may be seen as a further object of the present invention to provide a single use package that solves the above mentioned problems of the prior art with a new packaging system comprising a carrier for pharmaceutical composition and a holder of the carrier.

SUMMARY OF THE INVENTION

Multiple dispensing may be very convenient. However, multiple dispensing is not easy to achieve. Multiple access to several stored substances should be achievable in a convenient and easy way, while keeping high-level protection against undesired rupture or against contact between incompatible substances.

The invention is particularly, but not exclusively, advantageous for obtaining access to multiple dispensing as a simple and effective way of facilitating the simultaneous easy access and thus administration of storage incompatible substance particularly when said substances are taken as part of a complex sequential daily therapeutic or dietary regimen.

An advantage of the invention is the ability to facilitate simultaneous easy access and administration of prescription and non-prescription substances as part of a complex regimen.

The above-described object and several other objects are intended to be obtained in a first aspect of the invention by providing a carrier for pharmaceutical compositions, said carrier comprising at least a first and a second portion, each of the first and second portions comprising:

- at least two cavities for housing pharmaceutical composition, and
- at least one cover sheet covering said at least two cavities, said at least one cover sheet comprising elements, wherein the cavities of the first and second portions are arranged so that the first and second portions can be placed in an overlapping configuration with the cavities of the first portion positioned in spaces between the cavities of the second portion, and wherein

- at least one of the cavities of the first portion comprises at least one bulge, and
- at least one of the cavities of the second portion comprises at least one depression adapted to engage with said at least one bulge to form a mutual engagement between the first and second portions, by which engagement mutual movement of the first and second portions is restricted, so that a rigid structure is obtained.

The mutual engagement between the first and second portions may be obtained by folding and/or pressing of said second portion and said first portion onto each other. As part of this action, the at least one depression of the second portion will engage with the at least one bulge of the first portion whereby any subsequent mutual movement between the two portions are restricted. By "restricted" is preferably meant that the mutual movement of the two portions after engagement is more limited. They will typically still be manually mutually displaceable.

A rigid structure is herein defined as a structure with the characteristic of being firm, having a certain degree of stiffness, unbendability and inflexibility so as to allow for safe handling in transportation through normal post avoiding undesired rupture.

In an embodiment of such a carrier, at least one of the cavities of the first portion comprises at least two bulges extending in opposite directions, and at least two neighbouring of the cavities of the second portion each comprises at least one depression positioned and adapted to engage with one of the bulges of the at least one cavity of the first portion, the at least two neighbouring cavities with depressions having a cavity with bulges arranged in the space there between when the first and second portions are placed in an overlapping configuration, so that the engagement between the first and second portions is obtainable by engagement between the bulges and the depressions. Hereby a more rigid structure is obtainable.

In preferred embodiments of the invention, the bulges and depressions are dimensioned so that the engagement between the bulges and depressions result in a snap-fit being established.

In such an embodiment, the at least one cavity comprising at least two bulges may further comprise at least two protuberances extending in the same directions as the at least two bulges, the at least two protuberances being dimensioned and arranged to engage with surfaces of cavities of the second portion, so that mutual movement of the first and second portions is further restricted. Hereby the rigidity of the structure is further improved.

In preferred embodiments of the invention, the protuberance are dimensioned and arranged in relation to the cavities so that the engagement between the protuberances and the surfaces with which they engage results in an interference-fit being established. An interference fit, also known as a press fit or friction fit, is a fastening between two parts which is achieved by friction after the parts are pushed together, rather than by any other means of fastening.

The first and second portions may be made as separate units. Alternatively, the first and second portions may be made as two pivotally connected halves of one unit. Pivotally is herein defined as connected in a pivotal manner, e.g. by means of or on a pivot so that it can be turned around along a pivot such as a specific point, axes or edge, e.g. a fold line. Such a unit may e.g. one sheet of plastic or cardboard.

In some embodiments of the invention, the carrier is formed by folding the at least one of the two pivotally connected halves by 180° into an overlapping configuration so that the carrier halves lie on top of each other. Cavities are thus present on the top and bottom surface of the carrier.

In some embodiments of the invention, at least some of the cavities comprise a plurality of projections extending in a direction perpendicular to the at least one cover sheet. Such projections may be dimensioned and arranged so that they contact the other portion than the one on which they are arranged, so that a more rigid and stable carrier is obtained when the first and second portions are in mutual engagement. The improved stability is due to the larger number of contact points between the first and second portion of the carrier.

In some embodiments of the invention, projections are also present at other parts of the carrier, such as in the neighbourhood of bulges and depressions to further improve the stability of the engagement between the first and second portions.

In some embodiments, the carrier comprises one or more recess located on at least one edge of said carrier. There may be recesses on more than one edge of said carrier. Thus, recesses may define the shape of at least one of the edge of the carrier.

In embodiments comprising one or more recess, the cover sheet may cover the one or more recess. In particular, the elements of the cover sheet may cover the one or more recess. For some embodiments, the elements may comprise pinchable elements. In particular, the elements may be or may comprise tear-off elements, peel-off elements, snips, strips, flaps, or combinations thereof.

The first and/or second portion may have at least one bevelled corner.

In another aspect of the invention, the above-described object and several other objects are intended to be obtained by providing a pharmaceutical package comprising:

- a carrier for pharmaceutical composition as described above;
- a container for holding said carrier for pharmaceutical composition; wherein said container comprises at least two pivotally connected halves;

wherein at least one of said two pivotally connected halves comprises sidewalls having one or more indentation and when said carrier is contained in said at least one of said two pivotally connected halves, said one or more indentation allows for pinching said elements between thumb and another finger of a user.

Thus, the one or more indentations allow for access to the elements by a user. A pinchable element is an element that can be squeezed or pressed in between a thumb and a finger of a user, thus allowing for peeling-off and thus removal of the cover sheet.

Allowing for pinching the elements between thumb and index finger of a user allows in turn the easy removal of the cover sheet or at least part of the cover sheet and thus to effortless access to the content of the cavities protected by the cover sheet.

Pinching the elements refers to squeezing or pressing the elements with a thumb and a finger.

Access to the content of the blister is thus achieved by pinching and peeling off the cover sheet or at least part of the cover sheet. In that, pinching the elements may also refer to as squeezing and pulling the elements with a thumb and a finger, thus removing at least part of the cover sheet by pulling the elements.

Removal of the cover sheet provide access to multiple cavities thus providing a multiple opening and multiple dispensing of the composition contained in the cavities.

In some embodiments, when the carrier is contained in the at least one of the two pivotally connected halves, the one or more sidewalls surround the carrier.

In some embodiments, a cover sheet can be one cover sheet separated in independent portions by a punched through line.

A punched through line, maybe fully or partially punched through the coversheet and/or carrier, thus allowing for removal of part of the cover sheet, while leaving the rest of the cover sheet in place.

Independent portion having independent elements that can be squeezed and pulled independently provide selected access to selected cavities by removing only part, i.e. a portion, of the cover sheet, leaving other parts intact.

In some embodiments, the carrier comprises one or more recesses and the one or more sidewalls indentation and the one or more carrier recess are matching.

An indentation is a notch, a cut or a recess on the sidewalls of the at least one of the two pivotally connected halves. Indentations on the container sidewalls and carrier recess may be matching, i.e. may have a matching size allowing the user to pinch the element and thus remove the cover sheet to access the pharmaceutical composition or supplement contained in the cavities.

Indentations on the sidewalls of the container and carrier recesses may be mirroring in shape, i.e. creating a hollow passage between the sidewalls of the container or lid and the carrier sheet, thus allowing the user to pinch the element and thus remove the cover sheet to access the pharmaceutical composition or supplement contained in the cavities.

The indentations on the sidewalls and the recesses on the carrier are adapted to create a hollow passage between the sidewalls of the container and the carrier so as to allow the user to pinch the element and thus remove the cover sheet to access the pharmaceutical composition contained in the cavities.

The size or dimension of the indentations on the sidewalls is adapted to allow to quickly and easily grab, thus take and hold the element, such as a gripping element of the cover sheet.

In some embodiments, the one or more sidewalls indentations and the one or more carrier recesses are complementary, i.e. complementary in shape so as to allow quickly and easily grab, thus take and hold the element, such as a gripping element of the cover sheet.

In some further embodiments, at least one of the two pivotally connected halves is a carrier holder, and the other one of the two pivotally connected halves is a lid.

The at least one cover sheet is thus protected by at least one lid.

A carrier according to the invention may also be used without a container. In such embodiments, a lid may be a removable film, foil, rigid sheet, panel or a hollow body, which protects the cover sheet from undesired rupture.

The at least one lid may be made of plastic, plastic laminates, plastic/paper laminates or plastic/metal foil laminates or metal. Non-limiting exemplary suitable plastics for the carrier are laminates containing PVC, polyamides, polyolefins, polyesters, polycarbonates, Teflon and combinations thereof. The at least one lid may be also made of material which is at least partially transparent in visible range of light as to allow for visual inspection pharmaceutical composition contained in the cavities of the carrier.

In some embodiments the at least one lid is fully removable. In other embodiments the at least one lid may be opened through a rotation of the lid along at least one rotational joint located on the container.

The carrier holder and the lid may be pivotally connected.

In some other embodiments the at least one lid is or comprise at least one adhesive element, such as a long thin piece of plastic, cloth or paper with binding capabilities, e.g. a piece of tape. In those embodiments, access to the cover and carrier can be obtained through a rotation of the lid along one of the edges of the carrier.

In some embodiments the at least one rotational joint may be a hinge. In some embodiments the at least one rotational joint may be a pivot hinge. In some other embodiments the at least one rotational joint may be a pivot hinge with springs means for producing of a counter rotation moment. The presence of a pivot hinge allows for opening of the lid by a lateral rotation movement. In this embodiment closing of the lid is then obtained by the overlay of the lid onto the carrier holder by the opposite lateral rotation movement.

In some other embodiments the at least one lid is or comprise at least one hollow body, such a sleeve.

In some embodiments the at least one cover sheet may be protected by different lid system, for example access to the at least one cover sheet may be obtained through a slidable windows/shutters system.

The carrier holder may have one or more indentation on its sidewalls allowing for pinching the elements between thumb and another finger of a user.

In some embodiments the at least one of the two pivotally connected halves comprise a first and a second endwall wherein the first endwall comprises at least one protrusion extending towards the second endwall.

The at least one protrusion may be complementary to the at least one bevelled corner of the carrier.

The pharmaceutical package is adapted so that the carrier can be positioned inside the container in a desired direction, i.e. wherein the bevelled edge and the corresponding protrusion matches allowing for positioning of the carrier in a desired and predetermined position.

The carrier may hold one or more different kind of pharmaceutical compositions or supplements.

The carrier may be supplied separately from the holder. Refill carriers may be supplied accordingly having different kind and amounts of pharmaceutical compositions or supplements.

A pharmaceutical composition herein referred may comprise any biologically active substance, without limitation.

Pharmaceutical composition may be prescription or non-prescription substances or excipients for use in prescription or non-prescription substances.

Pharmaceutical composition may be a medicine or a supplement such as a dietary supplement.

Pharmaceutical composition may be prescription or non-prescription substances such as vaccines.

Non-prescription substances can be a vitamin or derivative thereof, or a mineral compound or derivative thereof.

Pharmaceutical composition herein referred may take any form, and combinations thereof. Examples of such forms include, without limitation, chewable tablet, quick dissolve tablet, effervescent tablet, reconstitute powder, elixir, liquid, solution, suspension, emulsion, tablet, multi-layer tablet, bi-layer tablet, capsule, soft gelatine capsule, hard gelatine capsule, caplet, lozenge, chewable lozenge, bead, powder, granules, dispersible granules, cachets, douche, suppository, cream, topical, inhalant, aerosol inhalant, patch, particle inhalant, implant, depot implant, dragee, ampoule, ingestible, injectable, infusion, health bar, liquid, food, nutritive food, functional food, yogurt, gelatine, cereal, cereal coating, animal feed or combinations thereof. The preparation of any of the above forms may be performed by techniques and methods well known and readily available to persons of ordinary skill in the art.

The first and other aspects or embodiments of the present invention may each be combined with any of the other aspects or embodiments. These and other aspects of the invention will be apparent from and elucidated with reference to the embodiments described hereinafter.

BRIEF DESCRIPTION OF THE FIGURES

The pharmaceutical package according to the invention will now be described in more detail with regard to the accompanying figures. The figures show one way of implementing the present invention and is not to be construed as being limiting to other possible embodiments falling within the scope of the attached claim set.

FIGS. 15.*a* and 15.*b* show two opposite orientations of one embodiment, and FIGS. 15.*c* and 15.*d* show another embodiment in a closed and in a half opened state, respectively.

DETAILED DESCRIPTION OF AN EMBODIMENT

Figure 1:
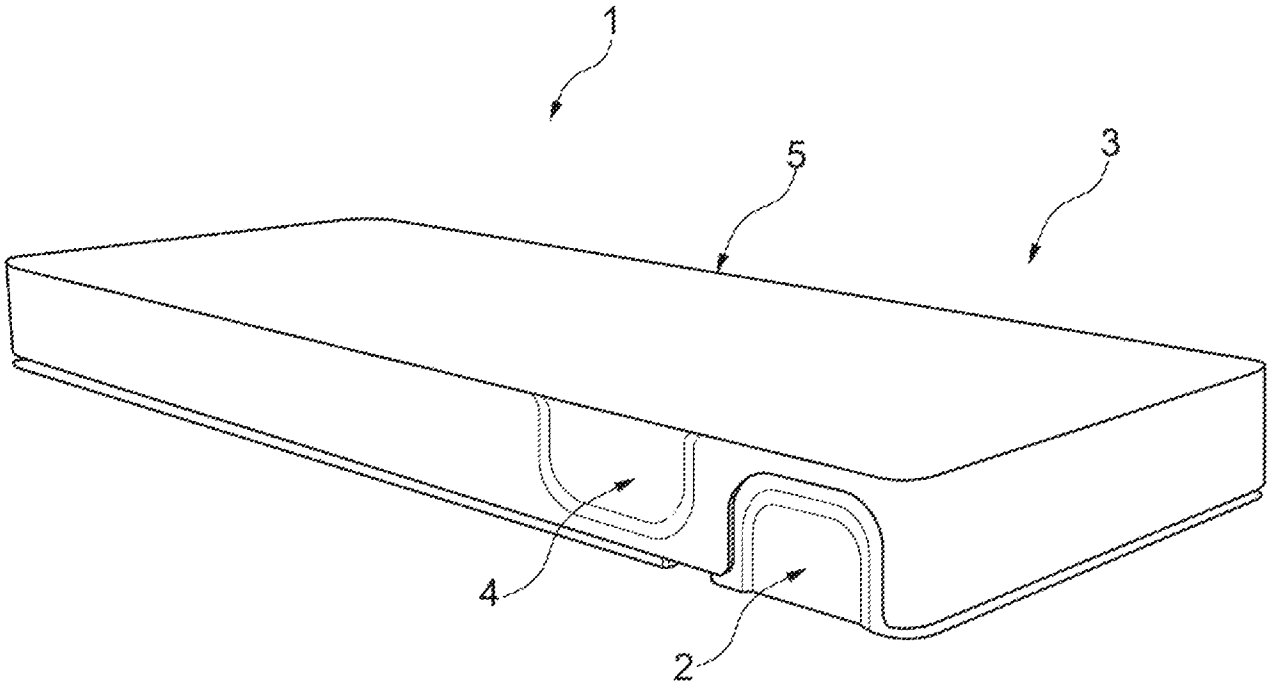
FIG. 1 shows a picture of the schematically 3-dimensional view of a single use pharmaceutical package in its closed state having two means for opening located on the longest and opposite sides of the according to some embodiments of the invention.

FIG. 1 shows a picture of the schematically 3-dimensional view of a single use pharmaceutical package 1 in its closed state. Package 1 shows opening elements 2 and 3 (not visible) located on the longest and opposite side of the package. FIG. 1 shows also gripping elements 4 and 5 (not visible) located on the longest and opposite side of the package. The gripping elements 4 and 5 and the opening elements 2 and 3 are located conveniently close to each other. The gripping elements may have the same size and shape of the opening elements thus providing a degree of child safety, as children will be confused on which one of the elements is the opening element, thus hindered from opening the package. In general, the package and/or the container and/or the lid may comprise functional and not functional elements having the same size and shape to provide a degree of child protection.

Figure 2:
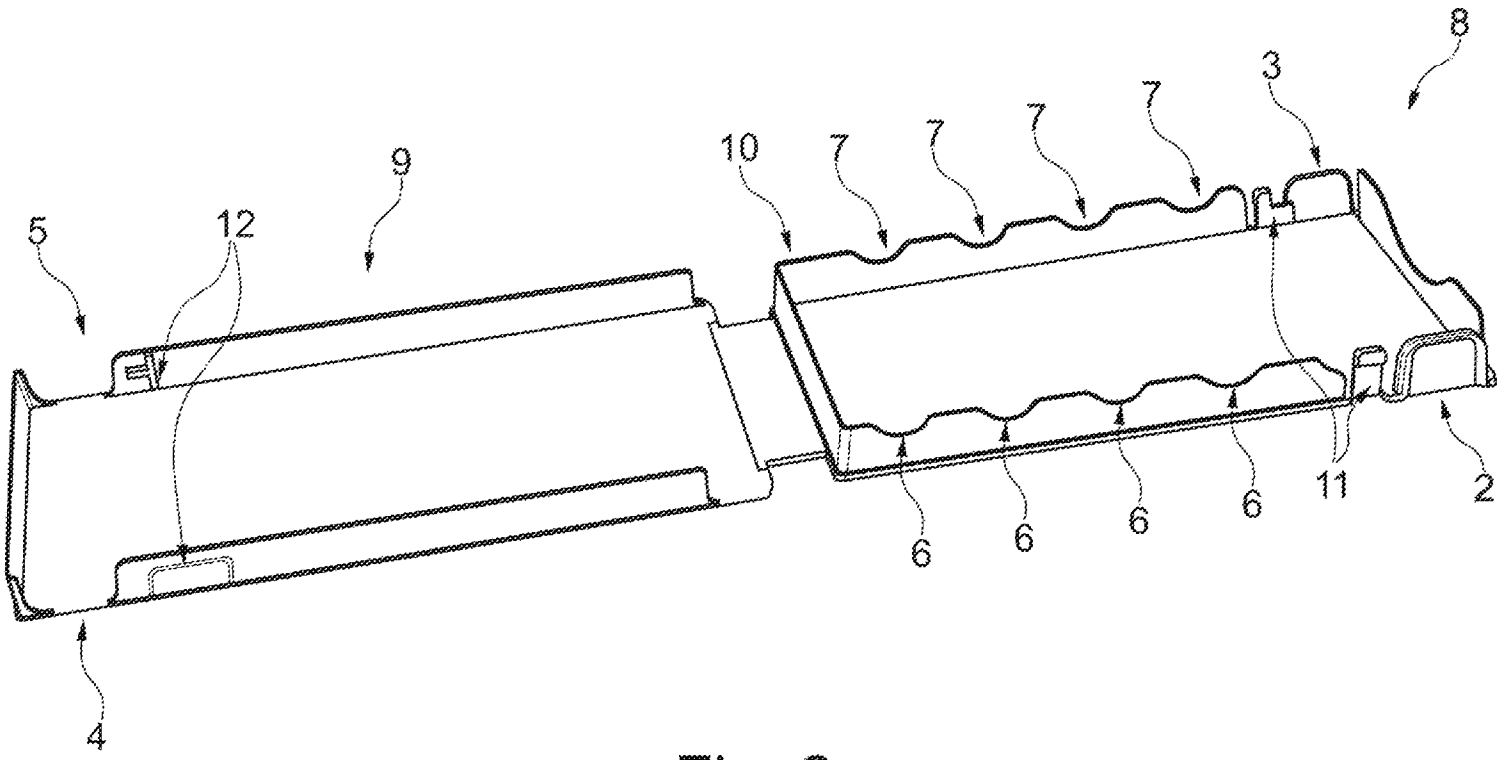
FIG. 2 shows a picture of the schematically 3-dimensional view of a single use pharmaceutical package in its open state when the carrier for pharmaceutical composition has been removed according to some embodiments of the invention.

FIG. 2 shows a picture of the schematically 3-dimensional view of a single use pharmaceutical package 8 in its open state when the carrier for pharmaceutical composition has been removed.

The container 8 comprises at least two pivotally connected halves, i.e. a lid 9 and a holder 10. Both may comprise sidewalls with one or more indentations. FIG. 2 shows the holder sidewalls having indentations 6 and 7.

Indentations 6 and 7 have a curved shape. However, indentations may have any shape, size or dimension allowing for finger access to the cover sheet covering the cavities of the carrier. Indentation is thus adapted to allow a finger to grab a gripping element present on at least part of the cover sheet.

The container 8 may be a casing such as a box made of plastic material, such as a hard polymer.

The lid 9 has the function of closing the container and protecting the contained carrier for pharmaceutical compositions. Lid 9 and holder 10 comprise opening elements with members 11 on the holder 10 that mutually engage with members 12 on the lid 9 upon folding and/or pressing of the lid 9 onto the holder 10.

Figure 3:
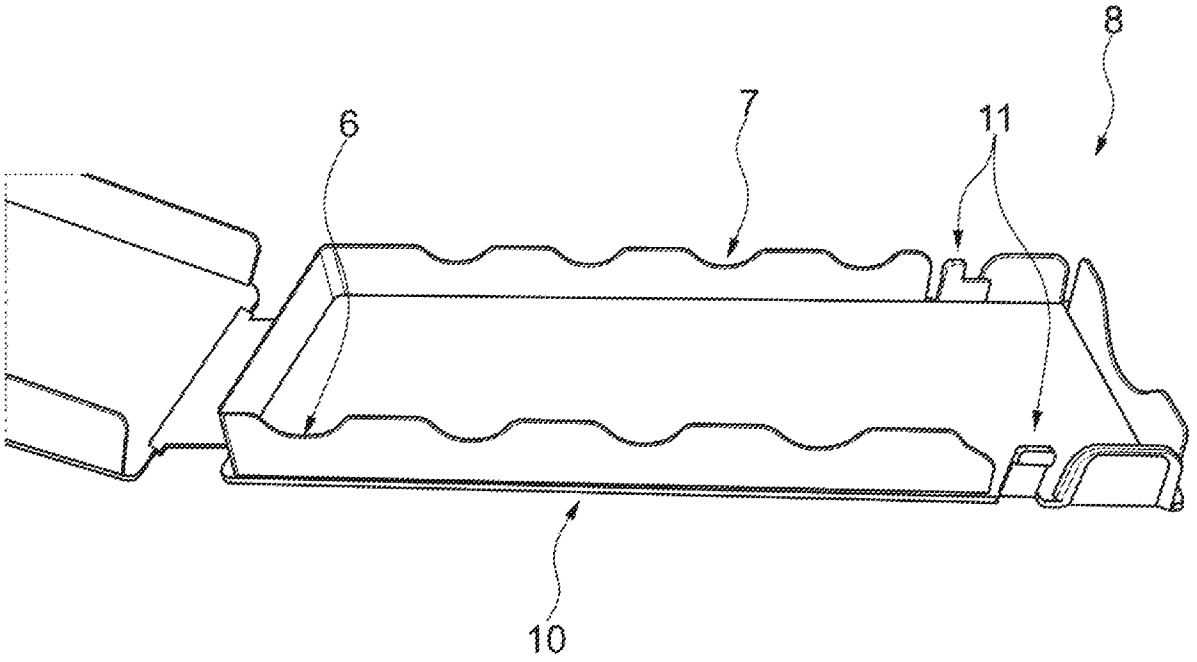
FIG. 3 shows a picture of the single use pharmaceutical package in its open state as depicted in FIG. 2.

FIG. 3 shows a picture of the single use pharmaceutical package 8 in its open state as depicted in FIG. 2.

Figure 4:
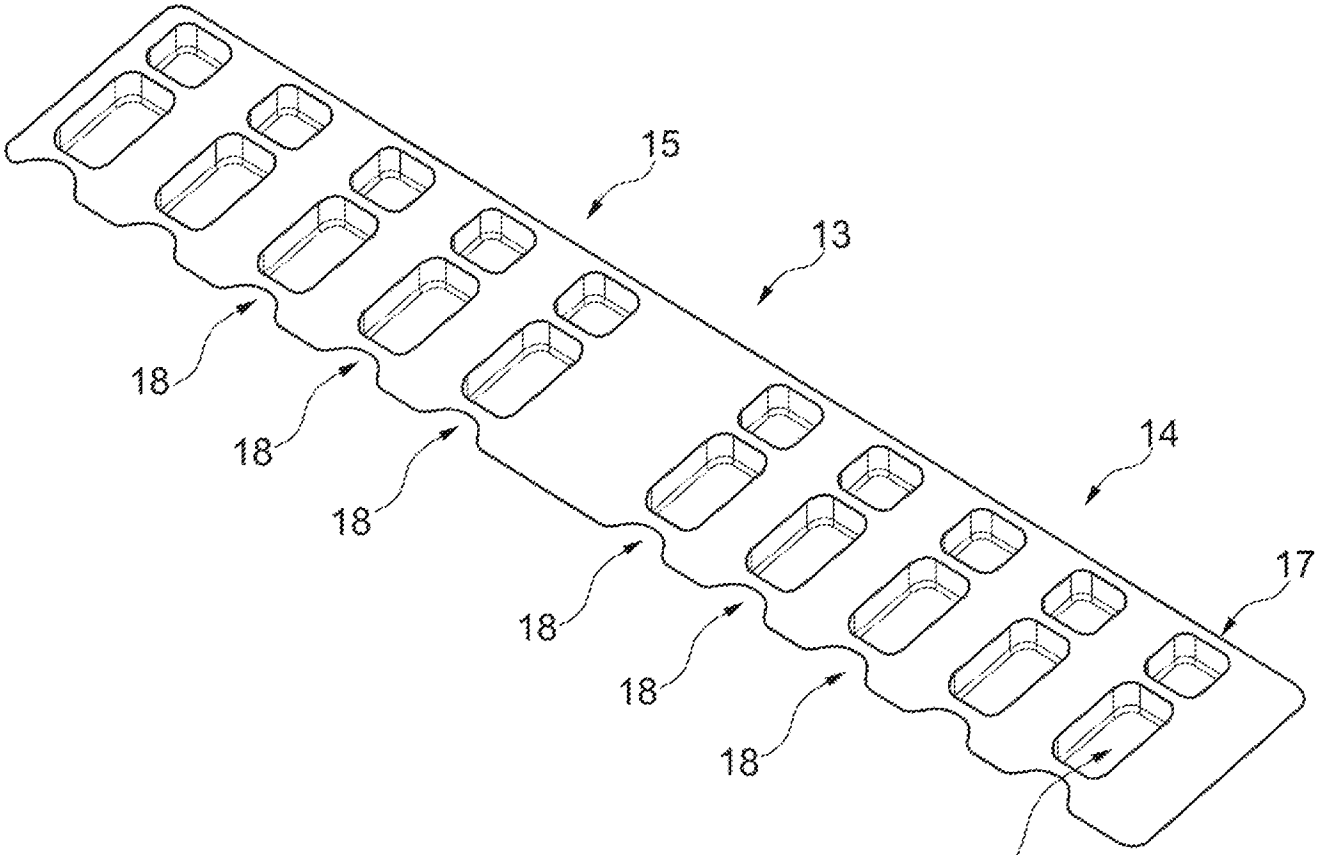
FIG. 4 shows a picture of the schematically 3-dimensional view of the top surface carrier in its unfolded state according to some embodiments of the invention.

FIG. 4 shows a picture of the schematically 3-dimensional view of the top surface of the carrier 13 in its unfolded.

The carrier 13 comprises at least a first 14 and a second portion 15. The first 14 and second portion 15 are adapted to mutually engage upon folding and/or pressing of said second portion 15 and said first portion 14 onto each other.

Cavities 16 and 17 have dimensions and sizes so as to accommodate one or more pharmaceutical compositions. For example, FIG. 4 shows a smaller cavity 17 where one pharmaceutical composition, e.g. in the form of capsule containing a liquid may be contained and a larger cavity 16, where more than one pharmaceutical composition, in the form of tables, may be contained.

The carrier 13 comprises recesses 18 on the edge of the carrier 13. Recesses may be on one or both side edges.

The carrier 13 is generally made out of a thermoformed plastic sheet.

Figure 5:
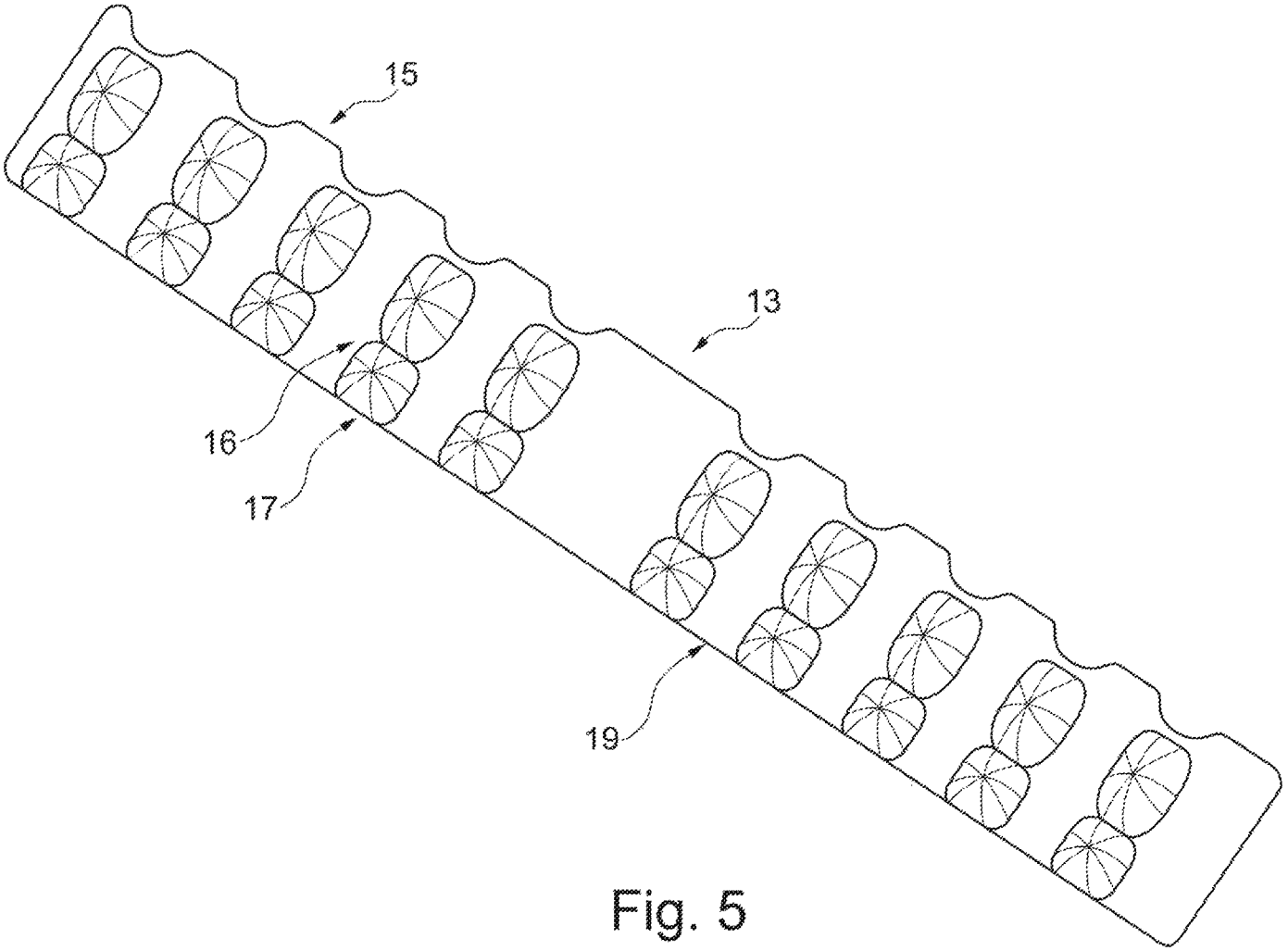
FIG. 5 shows a picture of the schematically 3-dimensional view of the bottom surface of the carrier in its unfolded state according to some embodiments of the invention.

FIG. 5 shows a picture of the schematically 3-dimensional view of the bottom surface of the carrier 13 in its unfolded state.

It can be seen that cavities 16 and 17 on the first portion 15 have size, dimension and shape that fit in the spaces 19 between other cavities of the second portion 14, so as to engage by interference fit between the other cavities of the second portion 14. Thus, by folding the first portion 15 onto the second portion 14 a rigid structure is produced.

Figure 6:
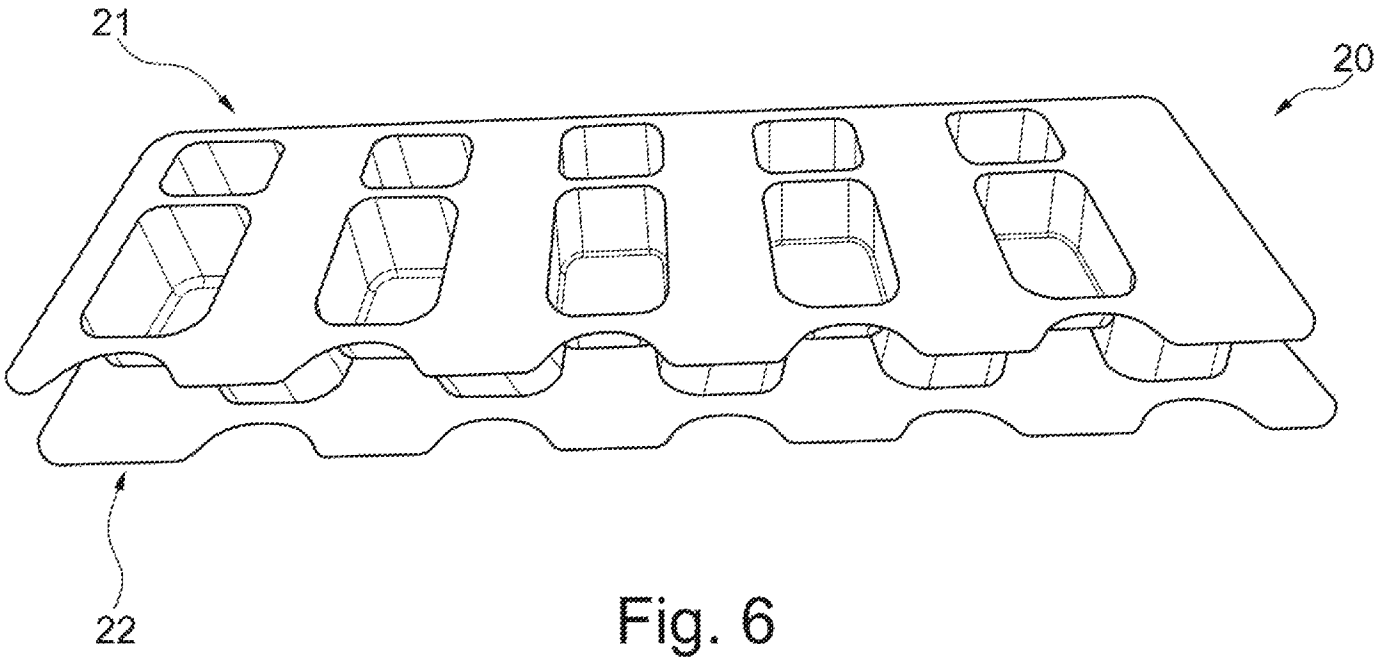
FIG. 6 shows a picture of the carrier in its folded state according to some embodiments of the invention.

FIG. 6 shows a picture of the carrier 20 in its folded state. Easy folding of the first portion 21 into the second portion 22, is possible as cavities of the first and second portion have complementary shapes. Thus, cavities on a first carrier portion are adapted to engage in an interference fit with cavities on a second carrier portion when the carrier is folded.

Two complementary shapes can be combined together so that their surfaces mutually engage, e.g. plug-socket or key-lock.

An interference fit, also referred to as a press fit, provides fastening between two carriers simply by friction after the carriers, e.g. the complementary shapes of the cavities, are pushed in contact.

FIG. 6 shows that the carrier 20 has recesses on its edge, which are on the same side of the carrier, whether the carrier is in its folded or unfolded state. Recesses are conveniently located on the same side of the carrier, while indentations are located on both of the longest and opposite sides of the holder. When the pharmaceutical composition contained in the cavities of the top surface of the carrier have been used, the carrier can lifted from the holder, turned by 180° and re-inserted in the holder. The bottom surface of the carrier becomes thus accessible and the cover sheet covering the bottom surface of the carrier gets accessible thought the indentation located on the opposite side of the holder.

Figure 7:
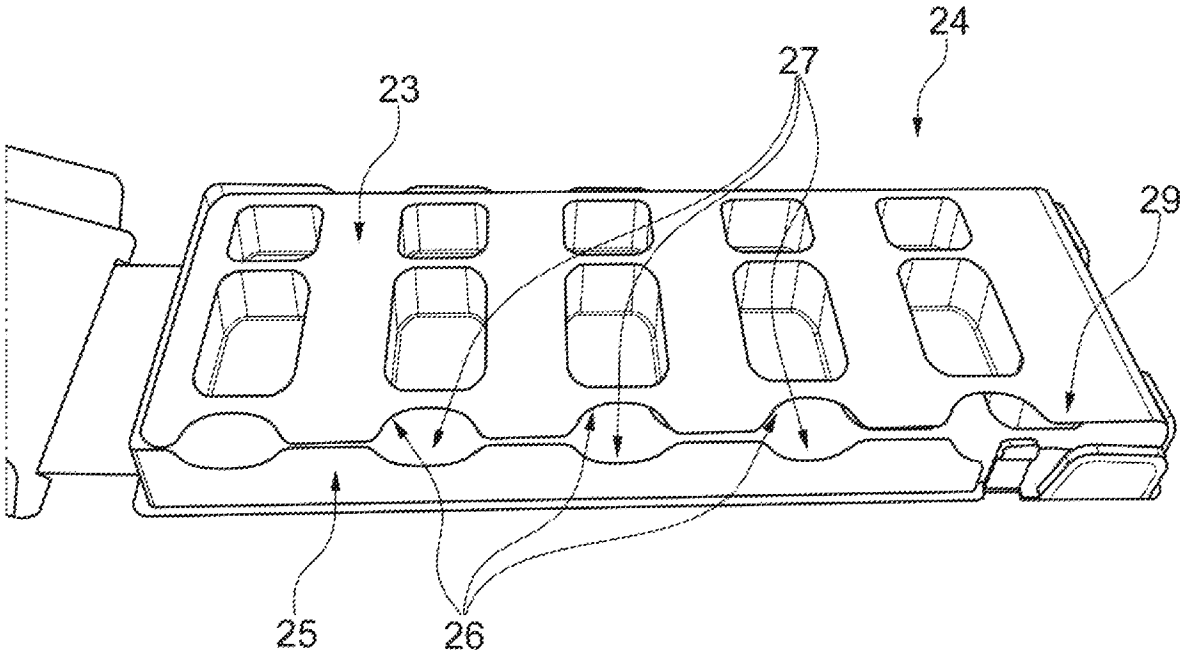
FIG. 7 shows a picture of the schematically 3-dimensional view of the carrier in its folded state contained in the holder according to some embodiments of the invention.

FIG. 7 shows a picture of the package 24 where the carrier 23 in its folded state contained in the holder 25.

Recesses 26 on the carrier 23 are matching with the indentations 27 on the sidewalls of the holder 25. This allow for a finger, such as a thumb to enter the opening created in between the indentations 27 and the recesses 26. When the carrier 23 contains pharmaceutical composition, a cover sheet (not shown) covers and protect the pharmaceutical composition and reach the edge 29 of the carrier 23, thus covering also the recesses 26.

Figure 7A:
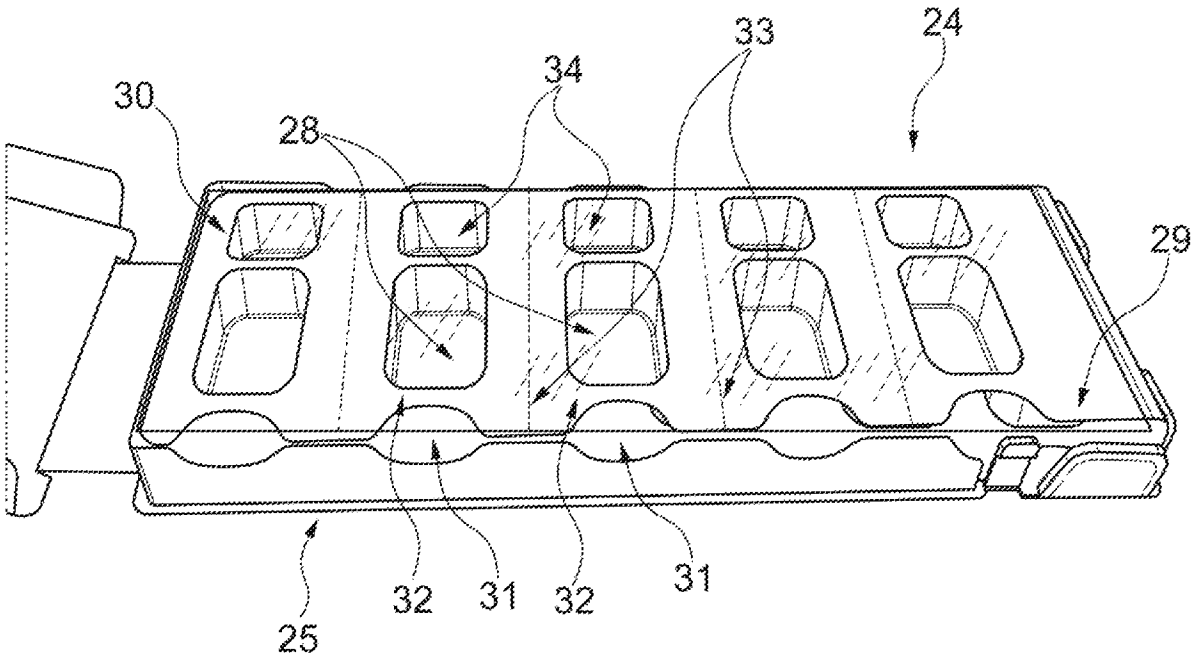
FIG. 7*a* shows the package of FIG. 7 where a cover sheet has been outlined onto the carrier.

FIG. 7*a* shows the package 24 of FIG. 7 where a cover sheet 30 has been arranged onto carrier 23. Cover sheet 30 reaches edge 29 and covers recesses 26.

The openings 31 defined by indentations 27 and cover sheet 30 covering recesses 26 allow for pinching of an element 32 between thumb and another finger of a user.

Punched lines 33 allow for multiple opening of cavities 34 and 28, while the other cavities remain sealed.

Figure 7B:
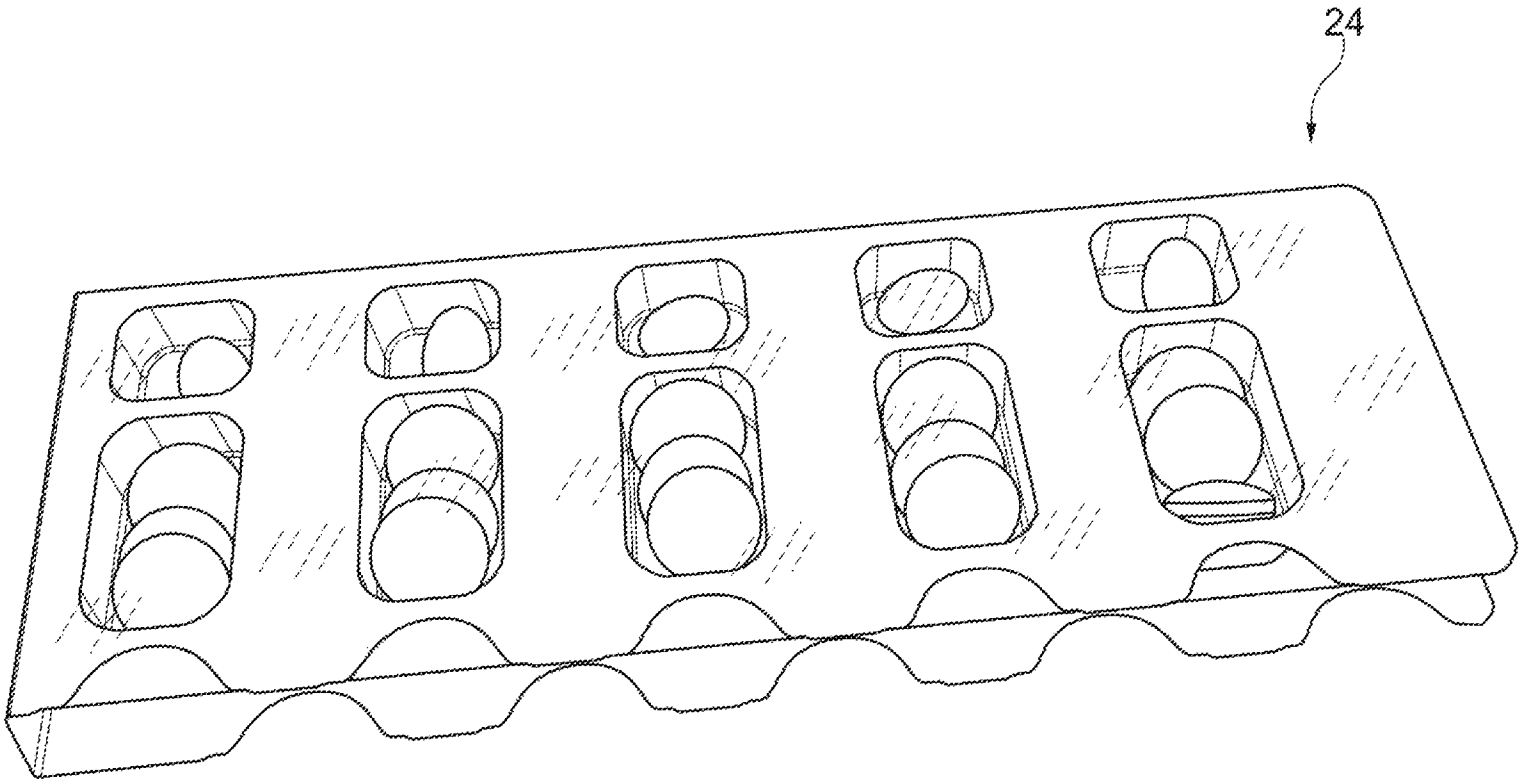
FIG. 7*b* shows the package of FIGS. 7 and 7*a* refilled with different pharmaceutical compositions or supplements protected by a transparent cover sheet.

FIG. 7*b* shows the package 24 wherein one of the cavities is filled with three tablets while the other cavity is filled with a capsule containing a liquid. The tablets and capsules are protected by a transparent cover sheet.

Figure 7C:
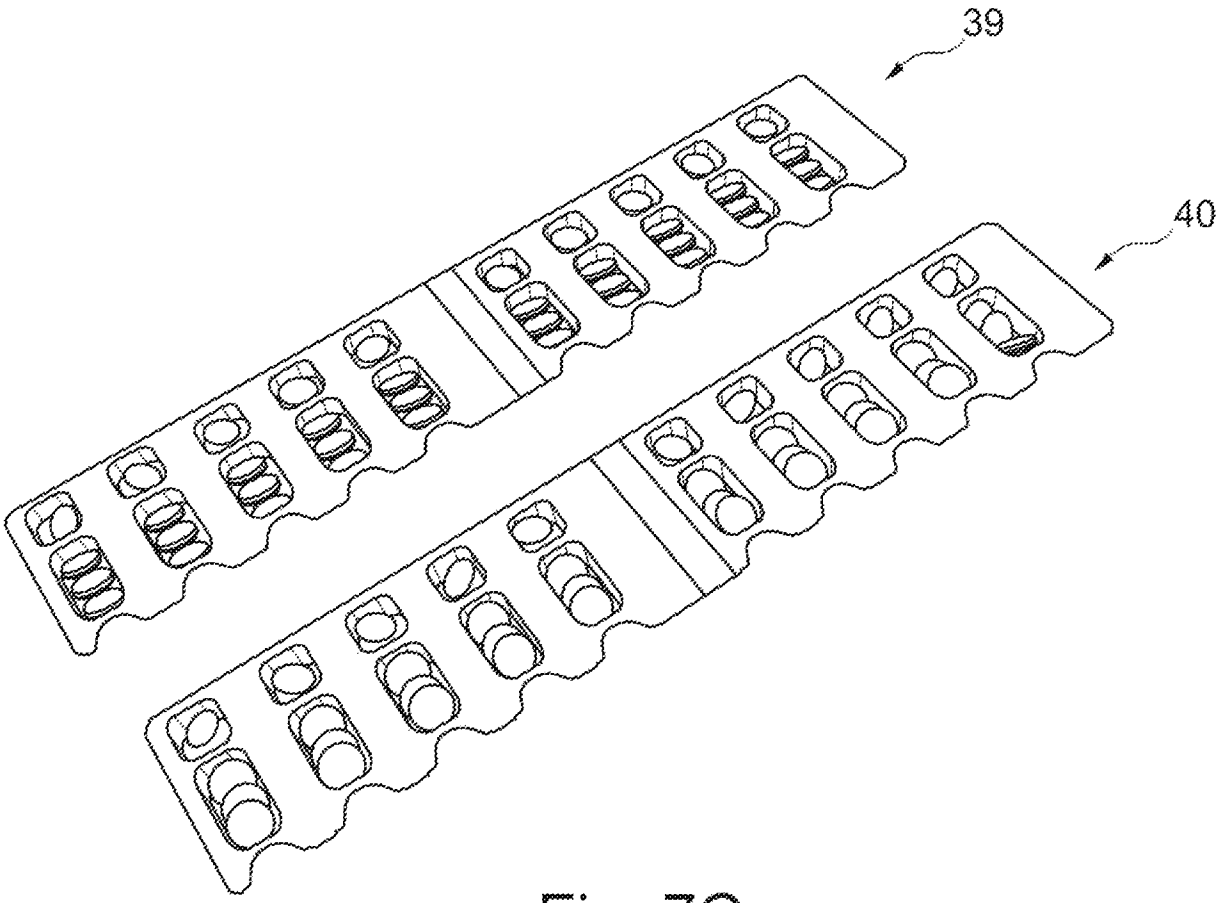
FIG. 7*c* shows the package of FIG. 7*b* in its unfolded state.

FIG. 7*c* shows the packages 39 and 40 in their unfolded state. It can be noticed that the positioning of the three tablets in the two packages is different according to different filling procedures.

Figure 8:
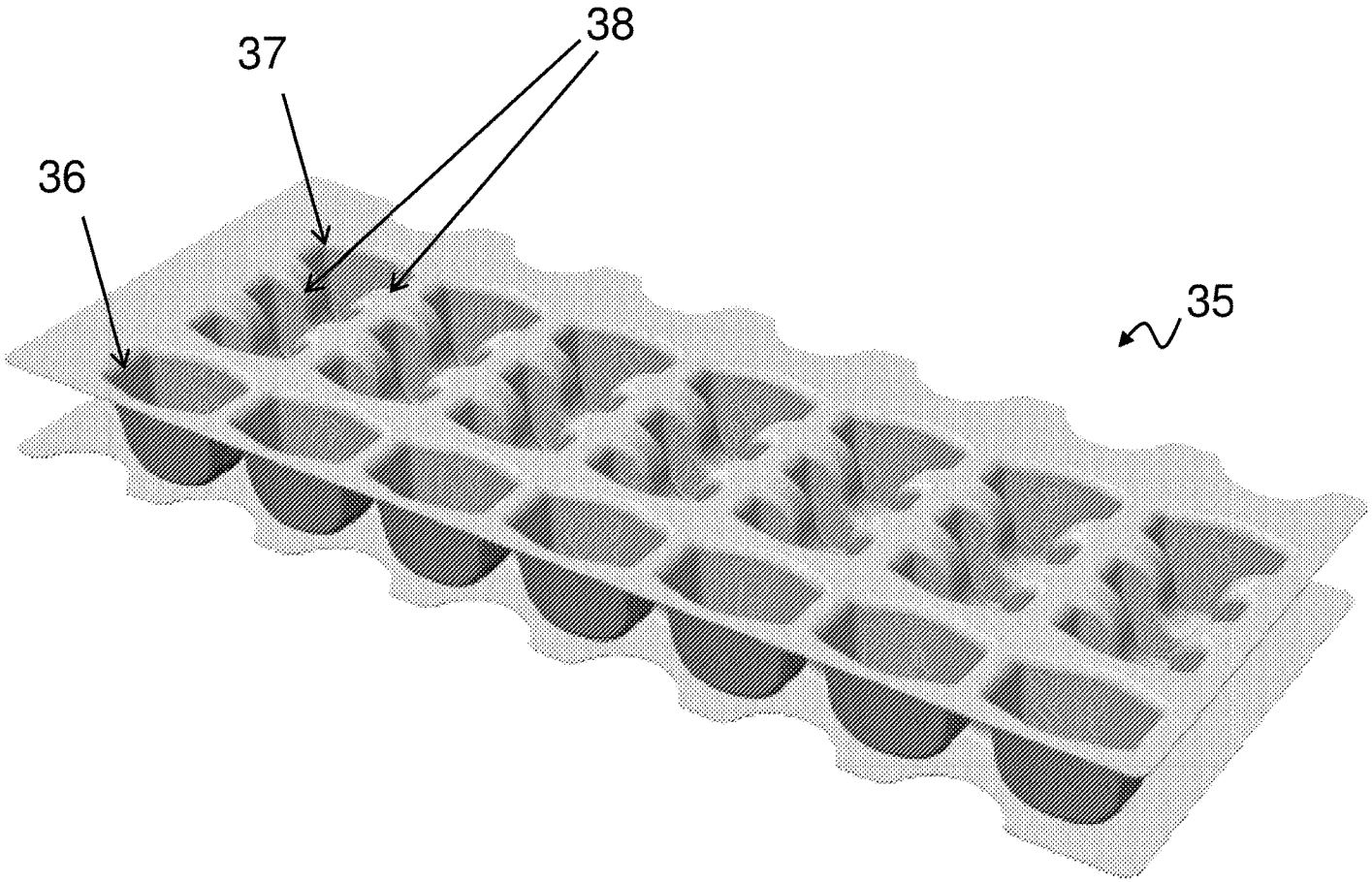
FIG. 8 shows a picture of the schematically 3-dimensional views of a carrier of a single use pharmaceutical package according to some embodiments of the invention.

FIG. 8 shows a picture of the schematically 3-dimensional views of a carrier 35 where at least one cavity has a multi-compartment feature. Carrier 35 has cavities 36 and 37. The space inside cavity 37 is separated by separations 38, such as partial walls 38. This ensures physical separation inside a single cavity between different pharmaceutical compositions or supplements in the form, e.g. of tablets.

Separation walls 38 have a dimension, i.e. a highest that is lower than the cavity depth. Thus, the number of sealing points required between the carrier surface and the cover sheet may be reduced compared to a carrier with multiple cavities.

A carrier having multi-compartments cavities has the advantage of allowing easy access to multiple pharmaceutical compositions or supplements that are stored in a way in which physical contact between pharmaceutical composition is still hindered.

Figure 9:
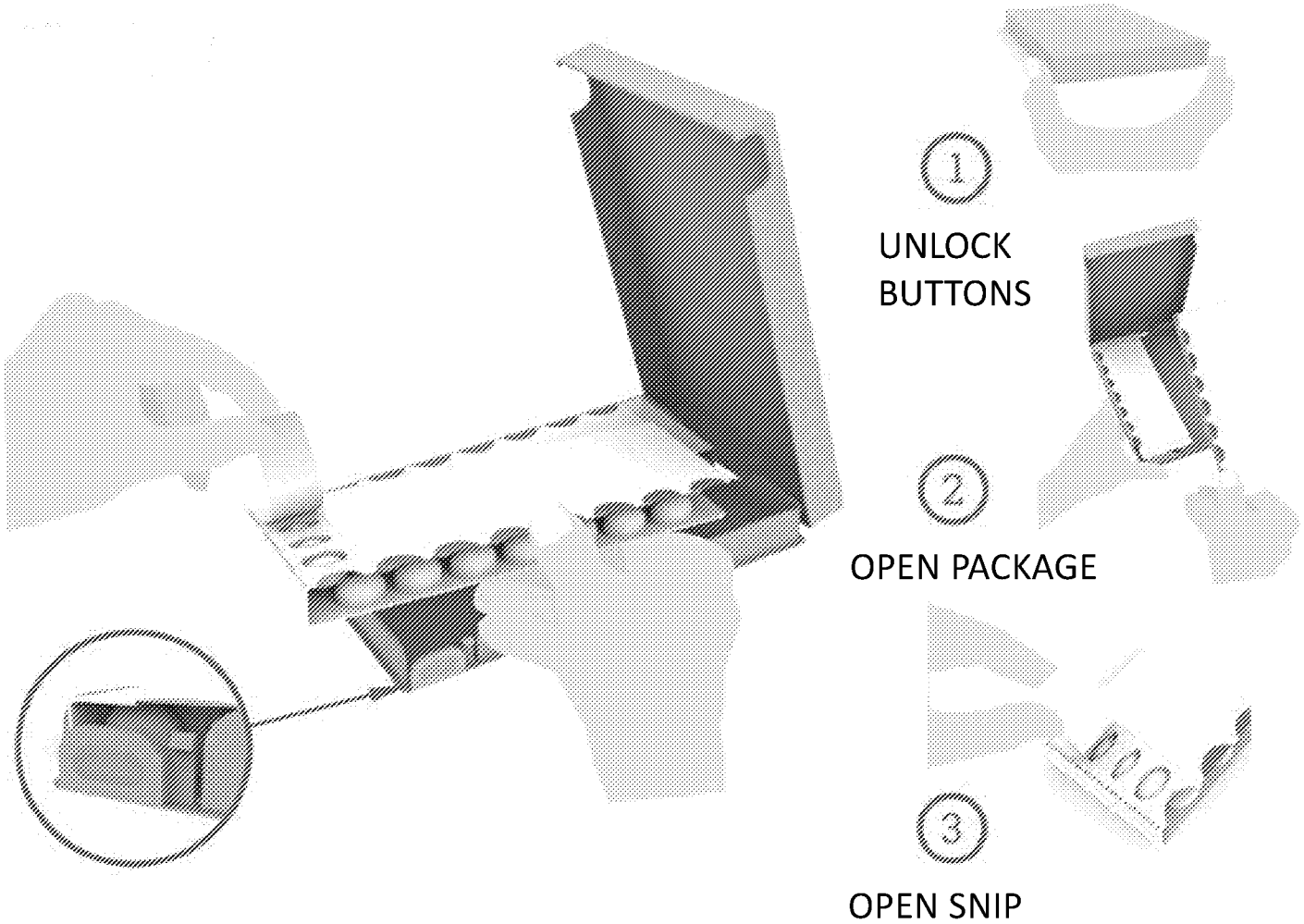
FIG. 9 shows a way to use the package and get access to the content of the container according to some embodiments of the invention.

FIG. 9 shows a way to use the package and get access to the content of the container according to some embodiments of the invention.

To open the pharmaceutical package, the opening means, such as unlock buttons may be pushed so as to open the container. The carrier may be removed and access to the tablets can be achieved by removal of a strip. This may be convenient when the holder does not have indentation along its side walls. Direct access to the content of the cavities may be achieved by direct removal of the strip element or part of the cover sheet while the carrier is contained in the holder, due to the presence of indentations, according to some other embodiments of the invention.

Figure 10:
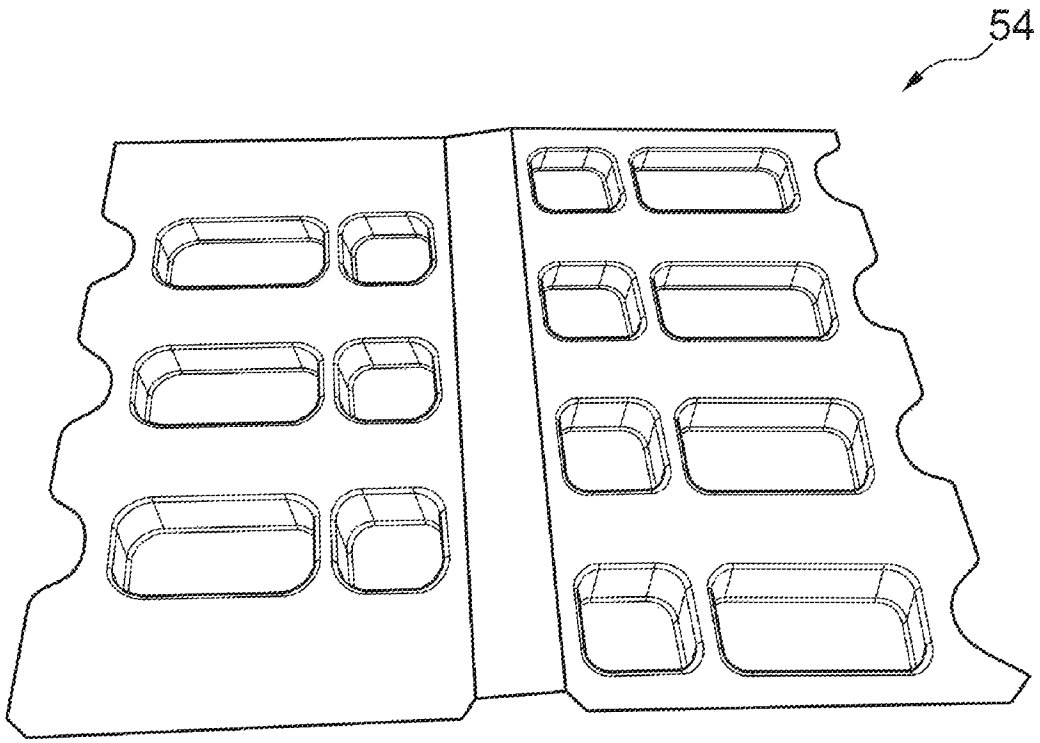
FIG. 10 shows a picture of the carrier in its unfolded state according to some embodiments of the invention.

FIG. 10 shows a picture of the carrier in its unfolded state according to some embodiments of the invention.

Figure 11:
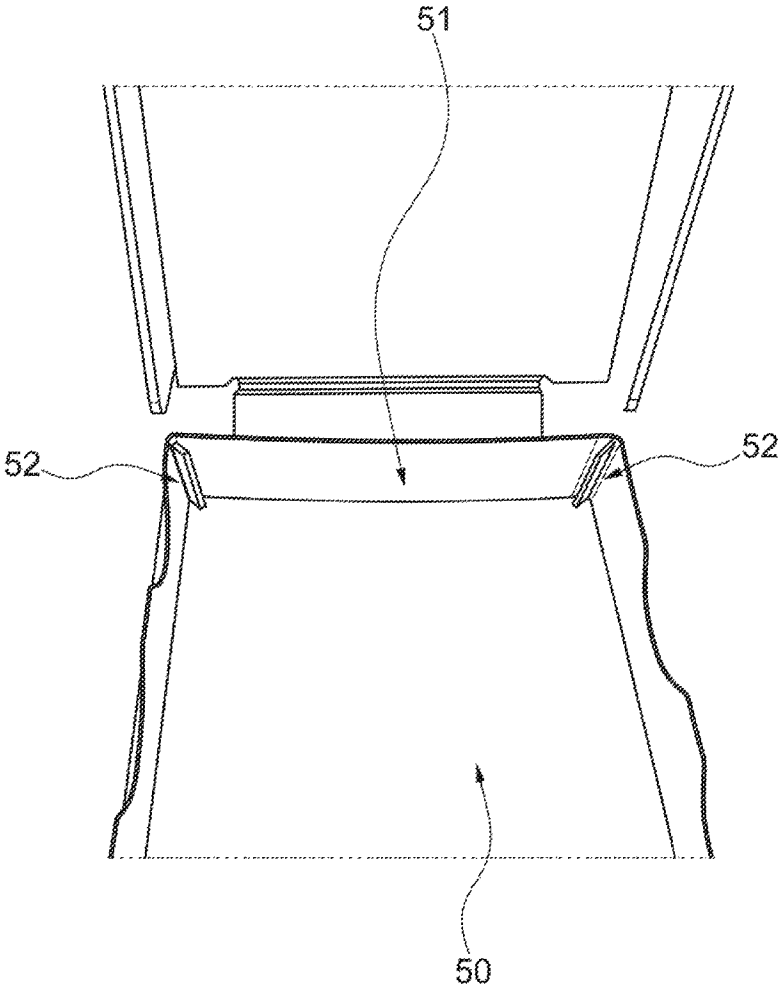
FIG. 11 shows a picture of the container for holding the carrier, according to some embodiments of the invention.

FIG. 11 shows a picture of the container for holding the carrier, according to some embodiments of the invention. FIG. 11 shows that the one of the two pivotally connected halves 50 of the container comprises a first endwall 51 that comprises two protrusions 52 extending towards the second endwall.

Figure 12:
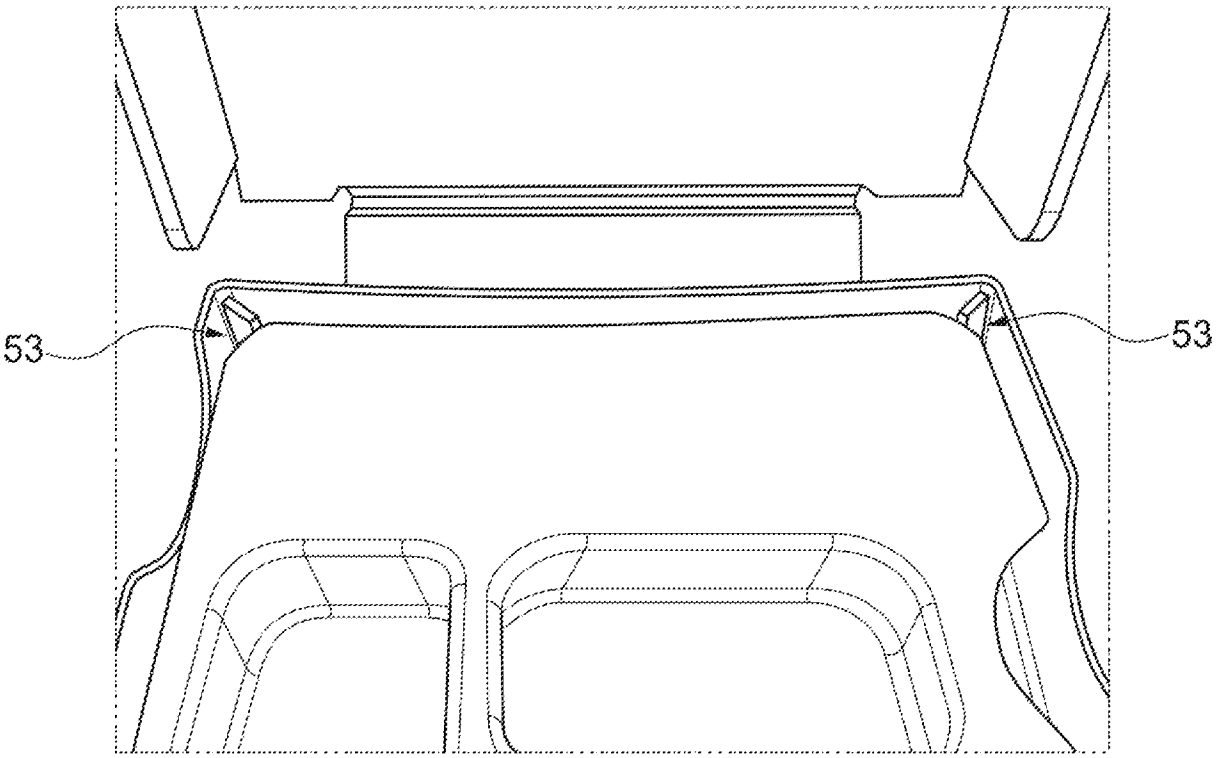
FIG. 12 shows a picture of the package where the carrier is inserted into the container, according to some embodiments of the invention.

FIG. 12 shows a picture of the package where the carrier is inserted into the container, according to some embodiments of the invention. FIG. 12 shows that the protrusions 52 may be complementary to bevelled edges 53.

Thus, the pharmaceutical package is adapted so that the carrier 54 when folded can be positioned inside the container in a desired direction, i.e. wherein the bevelled edges 53 and the corresponding protrusions 52 match allowing for positioning of the carrier 54 in a desired and predetermined position.

This has the advantage that the carrier containing pharmaceutical compositions or supplements may be positioned only in a desired direction thus allowing for perfect match between indentations on the sidewalls of the container and recesses on the edge of the carrier. In this way, a user will be able to easily pitch elements of the cover sheet for removing the cover sheet and access the cavities housing pharmaceutical compositions or supplements.

Figure 13:
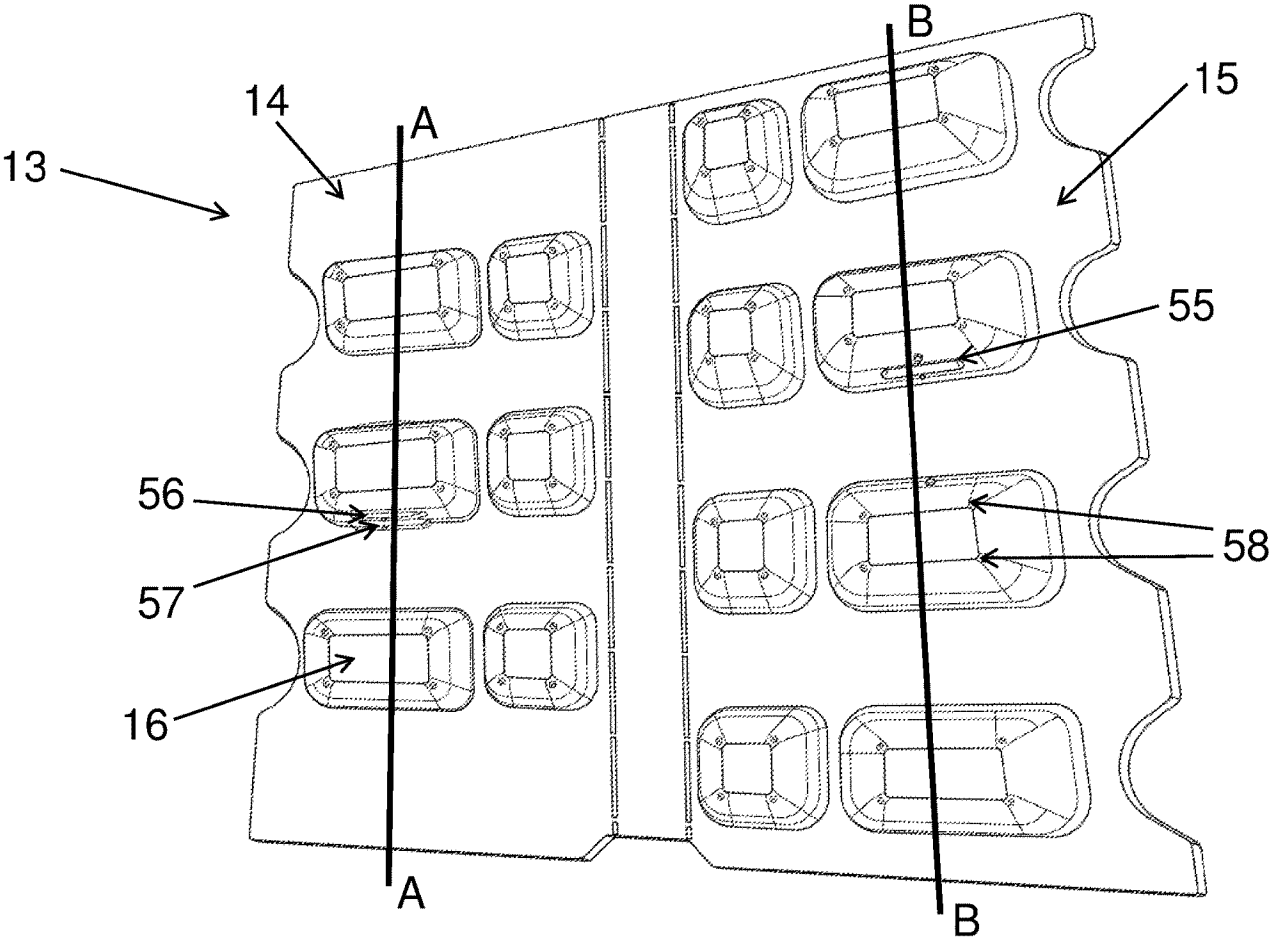
FIG. 13 shows a carrier where the cavities comprise bulges and depressions adapted for mutual engagement when the two portion are folded into a folded configuration.

FIG. 13 shows a carrier 13 according to the present invention, where one of the cavities 16 of the first portion 14 comprise bulges 56 extending in opposite directions, and two of the cavities 16 of the second portion 15 comprises depressions 55 adapted for mutual engagement when the two portions 14,15 are folded into a folded and overlapping configuration. Hereby a mutual engagement between the first and second portions can be obtained, by which engagement mutual movement of the first and second portions is restricted, so that a rigid structure is produced. The bulges 56 and depressions 55 are provided on the larger cavities in the embodiment in FIG. 13. However, it would also be possible to provide bulges and depressions on the smaller cavities instead of or in combination with those on the larger cavities. As shown in the figure, the cavity 16 comprising the two bulges 56 further comprises two protuberances 57 extending in the same directions as the two bulges 56. The two protuberances 57 are dimensioned and arranged to engage with surfaces of cavities 16 of the second portion 15, so that mutual movement of the first and second portions 14,15 is further restricted.

As shown in FIG. 13, the cavities may comprise a plurality of projections 58 extending in a direction perpendicular to the at least one cover sheet. Such projections 58 are preferably dimensioned and arranged so that they contact the other portion than the one on which they are arranged. Hereby a more rigid and stable carrier is obtained when the first and second portions are in mutual engagement. The improved stability is due to the larger number of contact points between the first and second portion of the carrier.

Figure 14:
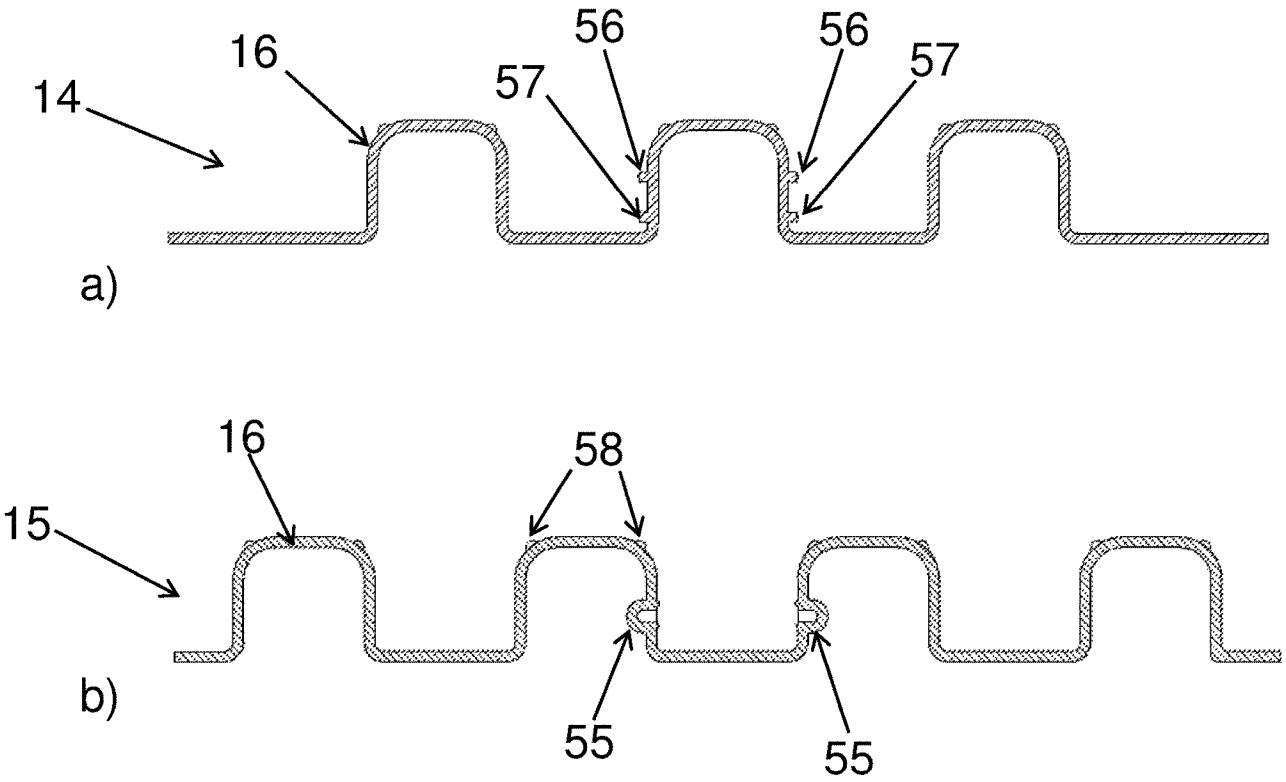
FIGS. 14.*a* and 14.*b* show the cross-sections of the carrier in FIG. 13 along the lines A-A and B-B in FIG. 13, respectively.

FIGS. 14.*a* and 14.*b* show the cross-sections of the carrier in FIG. 13 along the lines A-A and B-B in FIG. 13, respectively.

Figure 15:
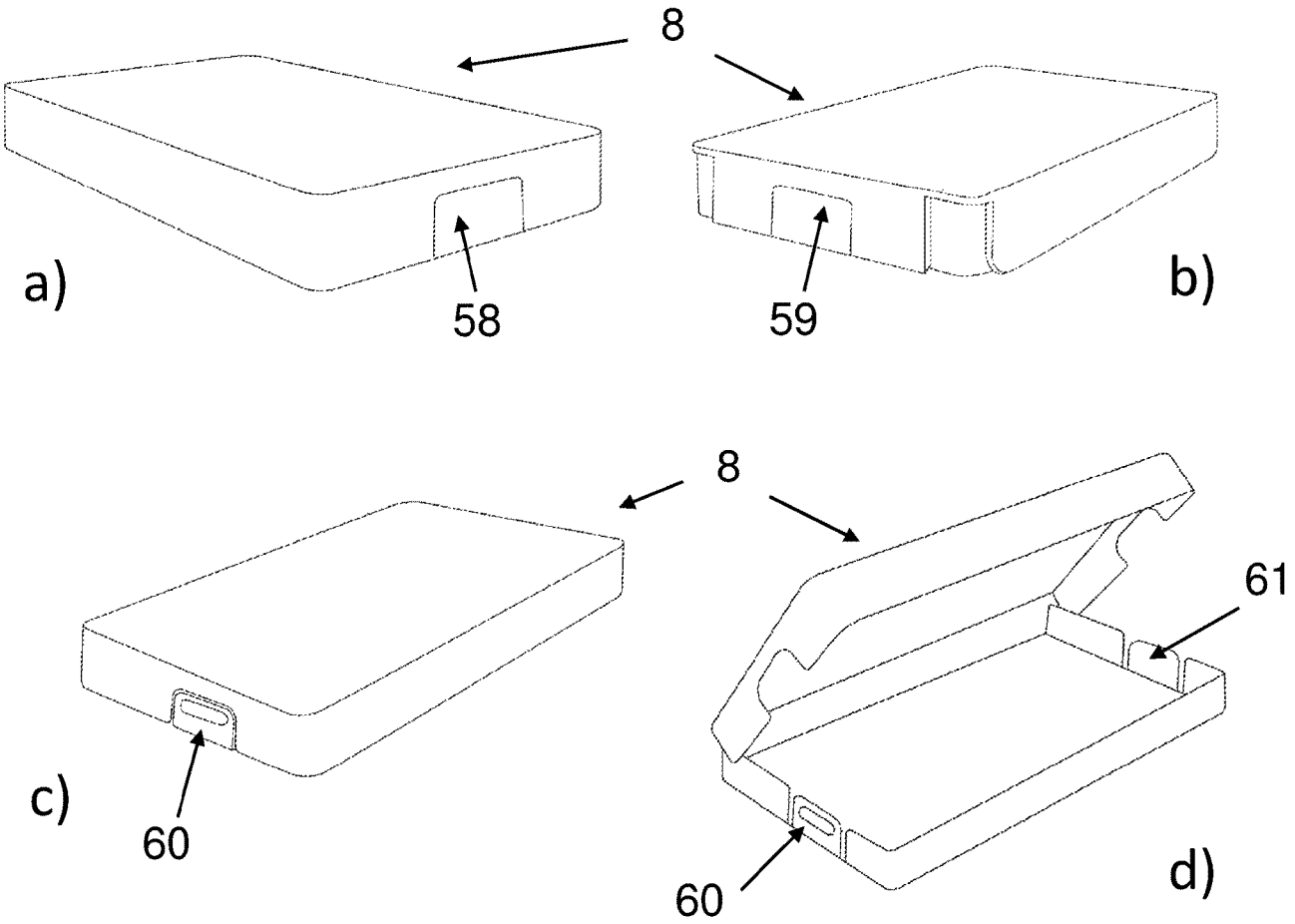
FIG. 15 shows two embodiment of the invention comprising a button for opening the container.

FIGS. 15.*a* and 15.*b* show schematically 3-dimensional views of a pharmaceutical package in its closed state having a pair of opening elements 58,59 located on the shortest and opposite sides of the pharmaceutical package according to some embodiments of the invention. In this way, a higher level of child safety is achieved, as a child's hand cannot simultaneously exert pressure on both opening elements 58, 59 located at a distance that is longer than the distance between the child's thumb and one of the child's four other fingers when opened.

FIGS. 15.*c* and 15.*d* show schematically 3-dimensional views of a container 8 of a pharmaceutical package in its closed state and while opening according to some embodiments of the invention. Upon applying pressure on the opening elements 60,61, the container 8 is unlocked and can be opened, whereby access to the content is obtained.

In FIG. 15, the container 8 is shown without the indentations for simplicity of illustration only; however, such indentations will be present in a container forming part of the pharmaceutical package according to the present invention.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A carrier for pharmaceutical compositions or supplements, said carrier comprising at least a first and a second portion, each of the first and second portions comprising:

at least two cavities for housing a pharmaceutical composition, and at least one cover sheet covering said at least two cavities, said at least one cover sheet comprising elements;

wherein the cavities of the first and second portions are configured such that the first and second portions can be placed in an overlapping configuration with the cavities of the first portion positioned in spaces between the cavities of the second portion, and wherein at least one of the cavities of the first portion comprises at least two bulges extending in opposite directions, and at least two neighbouring cavities of the second portion each comprises at least one depression positioned and configured to engage with one of said at least two bulges of the at least one cavity of the first portion to form a mutual engagement between the first and second portions resulting in a snap-fit being established, by which engagement mutual movement of the first and second portions is restricted, so that a rigid structure is obtained; the at least two neighbouring cavities with depressions having a cavity with bulges arranged in the space there between when the first and second portions are placed in an overlapping configuration, so that the engagement between the first and second portions is obtainable by engagement between the bulges and the depressions;

wherein the at least one cavity comprising at least two bulges further comprises at least two protuberances extending in the same directions as the at least two bulges, the at least two protuberances being dimensioned and configured to engage with surfaces of cavities of the second portion resulting in an interference-fit being established, so that mutual movement of the first and second portions is further restricted.

2. The carrier for pharmaceutical compositions or supplements according to claim 1, wherein the first and second portions are made as separate units.

3. The carrier for pharmaceutical compositions or supplements according to claim 1, wherein the first and second portions are made as two pivotally connected halves of one unit.

4. The carrier for pharmaceutical compositions or supplements according to claim 1, wherein at least some of the cavities comprise a plurality of projections extending in a direction perpendicular to the at least one cover sheet.

5. The carrier for pharmaceutical compositions or supplements according to claim 1, wherein said carrier comprises one or more recess located on at least one edge of said carrier.

6. The carrier for pharmaceutical compositions or supplements according to claim 5, wherein said at least one cover sheet covers said one or more recess.

7. The carrier for pharmaceutical compositions or supplements according to claim 1, wherein said elements are or comprise tear-off elements, peel-off elements, snips, strips, flaps, or combinations thereof.

8. The carrier for pharmaceutical compositions or supplements according to claim 1, wherein said first or second portion has at least one bevelled corner.

9. A pharmaceutical package comprising:

a carrier for pharmaceutical composition or supplements according to claim 1;

a container for holding said carrier for pharmaceutical composition;

wherein said container comprises at least two pivotally connected halves;

wherein at least one of said two pivotally connected halves comprises sidewalls having one or more indentation, and when said carrier is contained in said at least one of said two pivotally connected halves, said one or more indentation allows for pinching said elements between thumb and another finger of a user.

10. The pharmaceutical package according to claim 9, wherein said one or more sidewalls indentation and said one or more carrier recess are matching.

11. The pharmaceutical package according to claim 9, wherein, when said carrier is contained in said at least one of said two pivotally connected halves, said one or more sidewall surrounds said carrier.

12. The pharmaceutical package according to claim 9, wherein at least one of said two pivotally connected halves is a carrier holder, and wherein the other one of said two pivotally connected halves is a lid.

13. The pharmaceutical package according to claim 9, wherein at least one of said two pivotally connected halves comprises a first and a second endwall, wherein said first endwall comprises at least one protrusion extending towards said second endwall.

14. The pharmaceutical package according to claim 13, wherein said first or second portion has at least one bevelled corner, and wherein said at least one protrusion is complementary to said at least one bevelled corner.

* * * * *